US007156368B2

(12) United States Patent
Lucas et al.

(10) Patent No.: US 7,156,368 B2
(45) Date of Patent: Jan. 2, 2007

(54) SOLENOID ACTUATED FLOW CONTROLLER VALVE

(75) Inventors: Michael A. Lucas, Morgantown, IN (US); David L. Buchanan, Westport, IN (US); David M. Rix, Columbus, IN (US); C. Edward Morris, Jr., Columbus, IN (US); Donald J. Benson, Columbus, IN (US)

(73) Assignee: Cummins Inc., Columbus, IN (US)

( * ) Notice: Subject to any disclaimer, the term of this patent is extended or adjusted under 35 U.S.C. 154(b) by 243 days.

(21) Appl. No.: 10/823,692

(22) Filed: Apr. 14, 2004

(65) Prior Publication Data

US 2005/0230494 A1 Oct. 20, 2005

(51) Int. Cl.
*F02M 47/02* (2006.01)

(52) U.S. Cl. ..... 251/129.19; 251/129.18

(58) Field of Classification Search ..... 251/129.16, 251/129.18, 129.19
See application file for complete search history.

(56) References Cited

U.S. PATENT DOCUMENTS 4,964,571 A 10/1990 Taue et al.
5,072,882 A 12/1991 Taue et al.
5,450,876 A 9/1995 Reinicke
5,628,293 A 5/1997 Gibson et al.
5,984,210 A 11/1999 Forck et al.
6,056,264 A 5/2000 Benson et al.
6,059,203 A 5/2000 Streicher et al.
6,321,999 B1 11/2001 Male et al.
6,405,940 B1 6/2002 Harcombe et al.
6,510,841 B1 1/2003 Stier
6,688,579 B1 * 2/2004 Grytz ..... 251/129.16
6,796,543 B1 * 9/2004 Haeberer et al. ..... 251/50
6,997,432 B1 * 2/2006 Rapp ..... 251/129.16
2003/0062492 A1 4/2003 Haeberer et al.

FOREIGN PATENT DOCUMENTS

DE 101 31 125 A1 9/2002

* cited by examiner

*Primary Examiner*—J. Casimer Jacyna
(74) *Attorney, Agent, or Firm*—Nixon Peabody LLP; Tim L. Brackett, Jr.; J. Bruce Schelkopf

(57) ABSTRACT

A flow control valve for controlling the flow of fuel in a fuel system including a housing with a fuel passage, a valve device movable to close the fuel passage to block fuel flow through the fuel passage, and to open the fuel passage to permit fuel flow through the fuel passage, a valve plunger engaging the valve device, an actuator for reciprocally moving the valve plunger, an armature overtravel feature for permitting continued movement of the armature relative to the valve plunger from an engaged position into a disengaged position when the valve plunger reaches the extended position, and an armature stop for stopping overtravel of the armature.

15 Claims, 7 Drawing Sheets

FIG. 1A
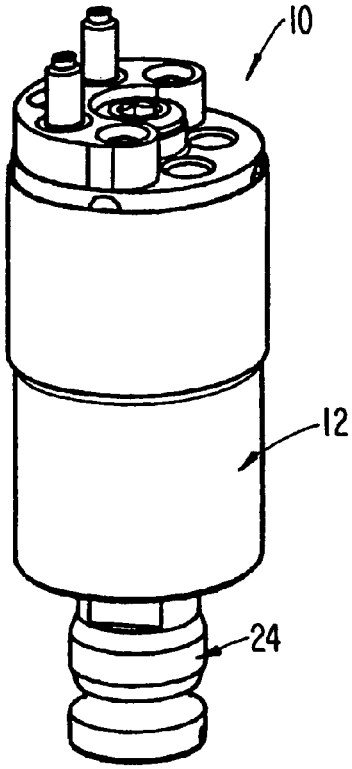
FIG. 1B
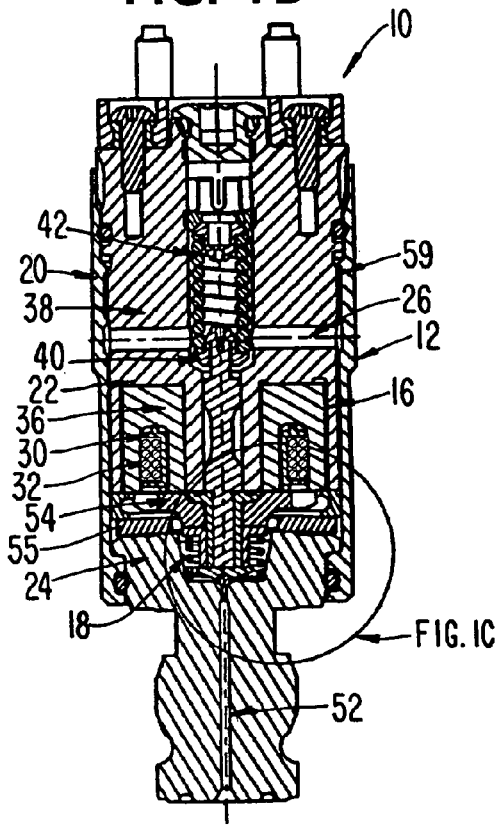
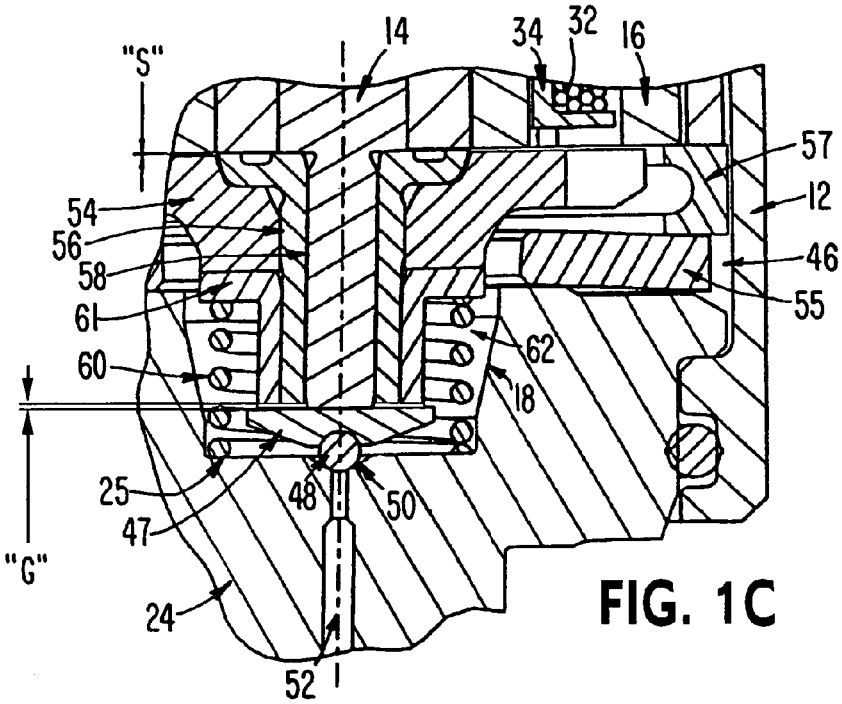
FIG. 1C

SOLENOID ACTUATED FLOW CONTROLLER VALVE

BACKGROUND OF THE INVENTION

1. Field of the Invention

The present invention is directed to a solenoid actuated flow control controller valve for a fuel system. In particular, the present invention is directed such a flow control controller valve with armature overtravel.

2. Description of Related Art

Electromagnetically actuated control valves are widely used in fuel injectors and timing fluid/injection fuel metering systems for precisely controlling the timing and metering of the injected fuel as well as timing fluid. Precise control of the timing and metering of fuel as well as timing fluid is necessary to achieve maximum efficiency of the fuel system of an internal combustion engine. This requires valve designers to consider these performance requirements in their designs. In addition, valve designers continually attempt to reduce the size of the control valves to reduce the overall size and weight of the engine and permit the control valves to be easily mounted in a variety of locations on the engine without exceeding packaging restraints.

Another concern of valve designers is valve seat wear and valve bounce. Control valves are often operated by a solenoid type actuator assembly. The response time of the controller valve has been decreased by improving the de-energizing response time of the actuator. However, as a result, the valve device closing velocity is increased resulting in increased impact forces on the valve seat. These high impact forces of the valve device against a valve seat cause excessive seat stresses, valve seat beating, and excessive wear. Moreover, when the valve impacts the valve seat at a high velocity, the valve tends to bounce off the seat adversely affecting the control of fluid flow and causing additional valve seat wear.

U.S. Pat. No. 6,056,264 issued to Benson et al. and assigned to the assignees of the present invention discloses a solenoid actuated controller valve that includes a valve plunger, a solenoid actuator with a coil and an armature, and an armature overtravel feature that permits continued movement of the armature relative to the valve plunger from an engaged position, into a disengaged position, when the valve plunger reaches a closed position. The armature overtravel feature includes an overtravel biasing spring for returning the armature from the disengaged position to the engaged position prior to subsequent energization of the actuator coil. As a result, the overtravel feature minimizes the mass impacting the valve seat thereby extending valve seat life while avoiding lost motion in the armature during the next actuation cycle to thereby minimize valve response time. The reference also discloses the use of an armature stop and fluid film that limits the amount of overtravel.

Thus, Benson et al. provides a significantly improved solenoid actuated flow controller valve which reduces the stress on the valve seat. However, a limitation in the solenoid actuated flow controller valve of Benson et al. is that there is variation in the amount of overtravel by the armature assembly. This can negatively affect the performance of the controller valve. In addition, significant secondary impact has been found to occur as described in further detail below that can also negatively affect the performance of the solenoid actuated controller valve.

U.S. Pat. No. 6,510,841 B1 issued to Stier and assigned to Robert Bosch GmbH discloses a fuel injector that utilizes a two-part armature which can reduce secondary impact and prevent an undesirable secondary short-term opening of the fuel injector. However, this reference does not disclose a fuel injector in which the armature assembly is decoupled from the valve needle or plunger. Thus, this reference does not disclose overtravel by the armature assembly to prevent high actuator seat stress.

Consequently, there is a need for a compact, inexpensive flow controller valve that allows overtravel by the armature assembly which avoids the limitations of prior art flow controller valves. In addition, there also exists an unfulfilled need for such a flow controller valve that minimizes the secondary impact.

SUMMARY OF THE INVENTION

As previously noted, a limitation in the solenoid actuated flow controller valve of Benson et al. has been found in that there is variation in the amount of overtravel by the armature assembly. Such variation in the amount of overtravel negatively affects the response time of the flow controller valve and reduces accurate metering and timing of the fuel. In addition, significant secondary impact has been found to occur as the armature assembly travels in the return direction after overtravel is completed. During secondary impact of the armature assembly, the load on the seat is reduced, thereby reducing the sealing margin between the valve and the valve seat and consequently, limiting the maximum system operating pressure. In addition, the secondary impact has also been found to negatively affect fuel metering, and in the worst case scenario, also cause secondary injection.

Therefore, in view of the foregoing, one aspect of the present invention is a solenoid actuated flow controller valve which minimizes variation in the amount of overtravel.

One advantage of the present invention is in providing a solenoid actuated flow controller valve that allows accurate metering and timing of the fuel.

Still another advantage of the present invention is in providing such a solenoid actuated flow controller valve that reduces the secondary impact so as to maintain the sealing margin and/or maximum system operating pressure.

These and other advantages are provided by a flow control valve for controlling the flow of fuel in a fuel system in accordance with one embodiment of the present invention, the flow control valve comprising a housing including a fuel passage, a valve device movable to close the fuel passage to block fuel flow through the fuel passage, and to open the fuel passage to permit fuel flow through the fuel passage, a valve plunger engaging the valve device, the valve plunger being adapted to reciprocally move between an extended position in which the valve device is moved to the closed position, and a retracted position in which the valve device is moved to the open position, an actuator means for reciprocally moving the valve plunger, the actuator means including a solenoid assembly including a coil capable of being energized to move the valve plunger into the retracted position and an armature connected to the valve plunger for movement with the valve plunger toward the extended position, an armature overtravel means for permitting continued movement of the armature relative to the valve plunger from an engaged position into a disengaged position when the valve plunger reaches the extended position, the armature overtravel means including an overtravel biasing means for returning the armature from the disengaged position to the engaged position prior to subsequent energization of the coil, and an armature stop means for stopping overtravel of the armature.

In accordance with one implementation, a valve seat is formed on the housing for sealing engagement by the valve device, the overtravel biasing means being positioned axially between the valve seat and the armature. The overtravel biasing means includes an overtravel biasing spring extending around the valve plunger in one embodiment. An armature sleeve may be provided circumscribing around at least a portion of the valve plunger.

In accordance with one preferred embodiment, the valve device includes a ball valve and a valve guide, as well as a retainer that circumscribes around at least a portion of the valve plunger and abuts the armature. One end of the overtravel biasing spring abuts the retainer while another end of the overtravel biasing spring abuts the valve guide of the valve device. In accordance with an alternative embodiment, the housing of the flow control valve includes a recess cavity for receiving the armature, the recess cavity including an inner bottom surface, the other end of the overtravel biasing spring abutting the inner bottom surface of the recess cavity.

In accordance with another implementation of the present invention, the armature stop means of the flow control valve includes a fluid film gap that fluidically resists overtravel movement of the armature, resistance to overtravel movement of the armature being determined at least partially by the dimension of the fluid film gap. The fluid film gap may be positioned between the retainer and the valve guide. In another embodiment, the retainer may include an upper piece that abuts the armature, and a lower piece secured to an end of the valve plunger. In such an embodiment, the fluid film gap may be positioned between the upper piece and the lower piece of the retainer, and the overtravel biasing spring also positioned between the upper piece and the lower piece of the retainer.

In accordance with another aspect of the present invention, the flow control valve may further include at least one of a spring disk and a solenoid spacer adapted to control a stroke distance moved by the armature when the solenoid assembly is energized to retract the valve plunger.

In accordance with still another embodiment of the present invention, a flow control valve for controlling the flow of fuel in a fuel system is provided comprising an armature housing including a fuel passage, a valve device including a ball valve and a valve guide, the valve device being movable to close the fuel passage and to open the fuel passage, a valve plunger engaging the valve device, the valve plunger being adapted to reciprocally move between an extended position, and a retracted position, a solenoid assembly actuable to move the valve plunger into the retracted position, the solenoid assembly including an armature connected to the valve plunger for movement with the valve plunger toward the extended position, the armature further being adapted to disengage from the valve plunger and to overtravel relative to the valve plunger, a retainer that circumscribes around at least a portion of the valve plunger and abuts the armature, an overtravel biasing spring extending around the valve plunger and being adapted to return the armature from the disengaged position to the engaged position, and a fluid film gap that fluidically resists overtravel movement of the armature.

In accordance with another embodiment, the housing of the flow control valve includes a recess cavity with an inner bottom surface, and the ends of the overtravel biasing spring abut the inner bottom surface and the retainer to thereby exert a return force on the armature, the fluid film gap being positioned between the retainer and the valve guide.

In still another embodiment, the ends of the overtravel biasing spring of the flow control valve abut the retainer and the valve guide to thereby exert a return force on the armature, the fluid film gap being positioned between the retainer and the valve guide.

In yet another embodiment, the retainer of the flow control valve comprises an upper piece that abuts the armature, and a lower piece secured to an end of the valve plunger, the ends of the overtravel biasing spring abutting the upper piece and the lower piece of the retainer, and the fluid film gap being positioned between the upper piece and the lower piece of the retainer.

These and other advantages and features of the present invention will become more apparent from the following detailed description of the preferred embodiments of the present invention when viewed in conjunction with the accompanying drawings.

BRIEF DESCRIPTION OF THE DRAWINGS

FIG. 1A is a perspective view of a solenoid actuated flow controller valve in accordance with one embodiment of the present invention.

FIG. 1B is a cross sectional view of the solenoid actuated flow controller valve of FIG. 1A.

FIG. 1C is an enlarged cross sectional view of a portion of the solenoid actuated flow controller valve shown in FIG. 1B that more clearly illustrates the overtravel feature of the present invention.

DETAILED DESCRIPTION OF THE PREFERRED EMBODIMENT

Figure 2:
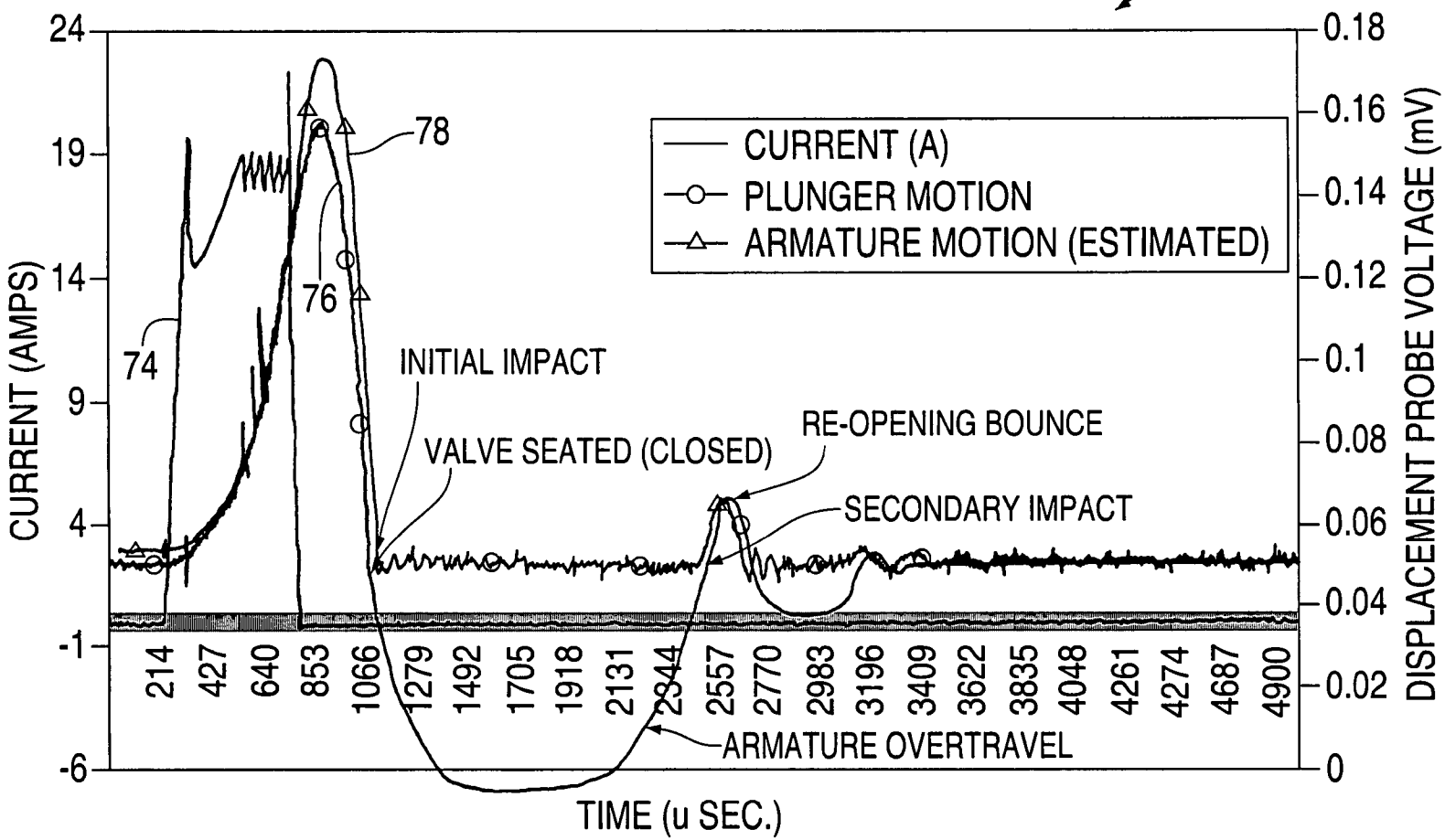
FIG. 2 is a graph showing armature overtravel and reopening bounce caused by the secondary impact of the armature in a conventional solenoid actuated flow controller valve having an armature overtravel feature.

FIG. 1A illustrates a perspective view of a solenoid actuated flow controller valve 10 in accordance with one example embodiment of the present invention which provides various advantages over flow controller valves of the prior art. As will be explained, the solenoid actuated flow controller valve 10 minimizes variation in the amount of overtravel by the armature. This increases accuracy in metering and timing of fuel provided through the flow controller valve 10, for example, the flow of fuel through a fuel injection system in an internal combustion engine. Furthermore, as also described below, the flow controller valve 10 reduces the secondary impact caused by the returning armature as compared to prior art flow controller valves.

This allows the sealing margin to be maintained so that maximum system operating pressure is not reduced.

Solenoid actuated flow controller valve 10 is provided with armature overtravel feature such as that generally disclosed in U.S. Pat. No. 6,056,264 to Benson et al. discussed above, the contents of which are incorporated herein by reference. In particular, as most clearly shown in the cross sectional views of FIGS. 1B and 1C, flow controller valve 10 generally includes valve housing 12, valve plunger 14 mounted for reciprocal movement in valve housing 12, valve actuator assembly 16 for selectively moving valve plunger 14 between extended and retracted positions, and armature overtravel feature indicated generally at 18.

Valve housing 12 includes upper portion 20 containing cavity 22 and lower armature housing 24 mounted in compressive abutment against a lower surface of upper portion 20. Upper portion 20 may include fuel passages 26 extending radially therethrough for communication with respective fuel passages for delivering fuel, for example, from a drain fuel source to an injector body and nozzle assembly (not shown) mounted adjacent to armature housing 24. In this regard, flow control valve 10 is preferably utilized in a fuel system and, in the preferred embodiment of FIGS. 1A to 1C, is readily positionable in the upper portion of a fuel injector (not shown).

Valve actuator assembly 16 includes solenoid assembly 30 having coil 32 mounted on bobbin 34 and extending around stator assembly 36. Solenoid assembly 30 is positioned in cavity 22 and securely attached to upper portion 20 of valve housing 12, preferably, by a metallic stator body 38. Valve plunger 14 is mounted for reciprocal movement in an aperture extending through stator body 38. A spring retainer and stop device 40 is mounted on an outer end of valve plunger 14 for receiving bias spring 42 for biasing valve plunger 14 downwardly as shown in FIG. 1B.

Valve actuator assembly 16 includes recess cavity 46 that is open toward coil 32 and stator assembly 36, and houses armature 54, disk spring 55, solenoid spacer 57, and components of overtravel feature 18. Valve plunger 14 extends through recess cavity 46. In contrast to the flow control valve disclosed in Benson et al. in which the plunger served to directly seal against a valve seat, flow controller valve 10 of the present invention is provided with a separate valve device. In particular, in the illustrated embodiment, the valve device is implemented as valve guide 47 that engages ball valve 48, plunger 14 abutting valve guide 47. Ball valve 48 seals along valve seat 50 formed in armature housing 24 and is movable to open or close fuel passage 52 is formed in armature housing 24. Of course, in other implementations of the present invention, a different valve device may be used in stead of the ball valve 48 and valve guide 47 shown. For example, a specially designed valve guide may be provided which directly seats against valve seat 50 so as to control the fluid flow through the fuel passage 52.

As can be seen, positioning of valve plunger 14 in the extended position as shown in FIG. 1C of the illustrated embodiment blocks fuel flow through fuel passage 52 via the ball valve 48. Armature 54 is mounted on valve plunger 14 for displacing valve plunger 14 between retracted and extended positions. In particular, energizing of coil 32 creates an attractive force between stator assembly 36 and armature 54 causing armature 54 to move toward stator assembly 36 thereby lifting valve plunger 14 to allow the ball valve 48 to lift off valve seat 50 into an open position so that fuel can flow through the fuel passage 52.

Armature overtravel feature 18 includes a movable connection between valve plunger 14 and armature 54 to permit continued movement of armature 54 relative to valve plunger 14 when valve plunger 14 is moved to close the ball valve 48 as described more fully herein below. Specifically, armature sleeve 56 is positioned in an internal bore extending through armature 54 and fixedly attached to armature 54 by, for example, an interference fit between armature sleeve 56 and armature 54. Armature sleeve 56 includes a central bore 58 for receiving valve plunger 14.

Armature overtravel feature 18 further includes an overtravel biasing spring 60 mounted in a spring chamber 62 formed in the armature housing 24. Overtravel biasing spring 60 is disposed around the retainer 61 which engages armature 54 and armature sleeve 56 in the manner most clearly shown in FIG. 1C. Overtravel biasing spring 60 in the illustrated embodiment is a coil spring which seats against inner bottom surface 25 of armature housing 24 at one end, and biases armature 54 and armature sleeve 56 into an engaged position against plunger 14 at an opposite end via retainer 61. As described more fully herein below with respect to the operation of the valve 10, armature 54 is permitted to move from the engaged position to a disengaged position upon valve plunger 14 being moved into the closed position where the valve ball 48 impacts valve seat 50. Overtravel biasing spring 60 then returns armature 54 to the engaged position in preparation for the next actuation cycle.

Armature overtravel feature 18 functions to reduce valve seat impact stresses and wear by reducing the impact to valve seat 50. Specifically, the impact is reduced by allowing armature 54, which represents a majority of the moving mass, to separate from the valve plunger 14 when plunger 14 is moved to the extended position and when ball valve 48 impacts valve seat 50. As a result, the mass of armature 54 is not a contributor to the force applied to valve seat 50 upon impact since armature 54 separates from plunger 14 and continues to move.

Thus, during operation, with actuator 16 de-energized, valve plunger 14 is in the extended position by bias spring 42 to press upon valve guide 47 so that ball valve 48 seats against valve seat 50 to block fluid flow through fuel passage 52. Also, armature 54, armature sleeve 56, and retainer 61 are biased against valve plunger 14 by overtravel biasing spring 60. Armature sleeve 56 and retainer 61 are dimensioned to be separated from valve guide 47 by a gap "G" when the valve guide 47 and ball valve 48 are in the closed position.

To actuate the flow controller valve 10, solenoid assembly 30 is provided with an electrical signal from an electronic control module (ECM—not shown) via a terminal connection at a predetermined time to energize solenoid assembly 30. This causes armature 54 and valve plunger 14 to move from the extended position shown in FIG. 1C, upwardly for a stroke distance "S", to a retracted position in which ball valve 48 lifts off valve seat 50 to thereby allow fuel flow through fuel passage 52.

In accordance with the illustrated embodiment of the present invention, the stroke distance S may be accurately controlled and/or adjusted by rotating valve housing 12 on threads 59 relative to valve actuator assembly 16. In the illustrated implementation, the change in stroke is dependent on the degree of rotation and the axial stiffness of the components in the load path such as the spring disk 55 and/or solenoid spacer 57. In particular, the axial thickness dimension of the solenoid spacer 57 may be increased or decreased to correspondingly adjust the stroke distance. In addition, the thickness dimension and/or spring rate of the spring disk 55 may be adjusted as well to also allow accurate control of the stroke distance S. This allows the solenoid actuated flow controller valve 10 of the present invention to be implemented in various applications thereby reducing development and component costs. For example, for different internal combustion engines, the corresponding different stroke requirements can be readily satisfied by merely selecting the appropriate spring disk 55 and solenoid spacer 57.

After the armature 54 is displaced the stroke distance S, and after a predetermined period of time, solenoid assembly 30 is de-energized. As the electromagnetic force decreases, valve plunger 14, armature 54, armature sleeve 56, retainer 61 and valve guide 47 begin to travel as an assembly toward valve seat 50 under the force of bias spring 42, causing the ball valve 48 to become seated on valve seat 50. When ball valve 48 impacts valve seat 50, the motion of valve plunger 14 and valve guide 47 are rapidly decelerated as explained below while an impact force is imparted to valve seat 50. However, armature 54, armature sleeve 56 and retainer 61 are not coupled to plunger 14 and therefore, continue to move downwardly as armature sleeve 56, in effect, decouples from valve plunger 14.

Armature sleeve 56 and retainer 61 decelerate as they approach valve guide 47 which is stationary when ball valve 48 impacts valve seat 50, armature 54 which is decoupled from plunger 14 also decelerated as well. One component of the force producing the deceleration is produced by the increasing pressure of the fluid in gap G between armature sleeve 56/retainer 61 and valve guide 47 as armature sleeve 56/retainer 61 move and gap G is reduced. In addition, another component of the force for decelerating the decoupled armature 54, armature sleeve 56 and retainer 61 is overtravel bias spring 60 which biases retainer 61 against the bottom of spring chamber 62 of armature housing 24 in the present embodiment.

The force generated by the pressurized fluid in gap G in combination with the overtravel bias spring 60 are sufficient to stop the motion of the armature sleeve 56/retainer 61 and armature 54 itself. In addition, the fluid pressure assists in bringing armature sleeve 56 and retainer 61 to a stop without damaging impact against valve guide 47. Of course, impact between armature sleeve 56/retainer 61 and valve guide 47 may, or may not occur depending on the operating condition. It should be noted that although FIGS. 1B and 1C appear to illustrate armature sleeve 56 and retainer 61 in contact with valve guide 47, a fluid film actually resists contact between these components under normal conditions. Thus, in the present embodiment, the valve guide 47 in conjunction with the fluid film act as an armature stop that resists damaging impact. Overtravel biasing spring 60 then moves armature sleeve 56, retainer 61, and consequently, armature 54, back into the engaged position against plunger 14.

Like the solenoid actuated flow control valve assembly described in Benson et al., flow controller valve 10 of the present embodiment provides various advantages over conventional control valves that are not provided with an armature overtravel feature. First, armature overtravel feature 18 as described effectively reduces the magnitude of the impact forces against valve seat 50, thus decreasing valve seat stress, wear and valve bounce. Second, overtravel biasing spring 60 effectively minimizes valve response time by returning armature 54, armature sleeve 56 and retainer 61 to the engaged position prior to the next actuation event. Thus, upon actuation of solenoid assembly 30 during the subsequent cycle of operation, any movement in armature 54 results in corresponding movement of valve plunger 14. This avoids the lost motion of the armature during each cycle that may be present in conventional control valves thereby reducing the response time of the assembly resulting in more predictable and accurate control over fuel flow.

In addition, the flow controller valve 10 of the present invention provides various advantages over even the flow control valve described in Benson et al. In particular, as previously noted, a limitation in the solenoid actuated flow controller valve of Benson et al. is the variation in the amount of overtravel by the armature assembly. Such variation in the amount of overtravel negatively affects the response time of the flow controller valve and decreases the accuracy in metering and timing of the fuel. In addition, significant secondary impact has been found to occur as the armature assembly travels in the return direction after overtravel is completed. During secondary impact of the armature assembly, the load on the seat is reduced, thereby limiting the maximum system operating pressure by reducing sealing margin. In addition, the secondary impact negatively affects fuel metering, and in the worst case scenario, can also cause undesirable secondary injection to occur.

By implementing flow controller valve 10 in accordance with the present invention in which plunger 14 abuts against ball valve 48 via valve guide 47, and in which gap G is provided, the above noted limitations of prior art flow control valves such as Benson et al. can be significantly reduced. More specifically, the dimension of gap G and the radial surface area of the gap G are selected to provide the desired amount of volume of fluid that is pressurized. In other words, the tubular thickness of armature sleeve 56 and/or retainer 61, as well as the dimension of gap G may be selectively adjusted to provide the desired amount of squeeze film damping between armature sleeve 56/retainer 61 and valve guide 47.

Thus, the present invention described above allows the amount of overtravel (and the required cycle time of overtravel) to be controlled by controlling the amount of squeeze film. This allows minimization of overtravel variation while allowing obtaining of desired performance. In multi-pulse operation, the cycle time of the overtravel can also be controlled by controlling the amount of squeeze film to prevent fueling variation due to pulse separation. In addition, the time constraint of the secondary impact may also be adjusted and effectively controlled by optimizing the dimension of gap G and the radial surface area. The inventors have found that setting of the dimension and radial surface area of gap G allows the overtravel stroke to be limited to +/−10 μm in the flow controller valve 10 of the present embodiment. Such precise control of the overtravel and secondary impact effectively minimizes injector-to-injector fueling/timing variation as well as shot-to-shot fueling/timing variation that can be caused by overtravel variation during normal operation, as well as multi-pulse operation. Moreover, because the present invention makes the actuator stroke independent of the overtravel stroke, compatibility with stroke adjustable actuators is maintained.

FIG. 2 shows graph 70 illustrating armature overtravel and re-opening bounce caused by the secondary impact of the armature in a conventional solenoid actuated flow controller valve with armature overtravel that operates in a manner described in the Benson et al. reference. As shown, line 74 is the current (in Amperes) that is provided to a conventional flow control valve over time (in microseconds). The provision of the current causes the plunger of the flow controller valve to move in the manner shown by line 76 (line with circles), the motion being indicated by the displacement probe voltage (microvolts). Moreover, the armature also correspondingly moves in the manner shown by line 78 (line with triangles), this motion being estimated.

As can be seen, at approximately 1070 microseconds, the initial impact occurs and the plunger impacts the valve seat thereby closing the flow passage. However, as described in the Benson et al. reference, the armature continues its displacement and the armature overtravels as shown. The armature reaches it's peak armature overtravel at approximately 1700 microseconds and is displaced back so that at approximately 2500 microseconds, the armature again engages the plunger causing a secondary impact. The secondary impact can actually cause the plunger to re-open as indicated by re-opening bounce. As previously explained, such secondary impact is undesirable since it can reduce the load on the valve seat and reduce the sealing margin thereby limiting the maximum system operating pressure. In addition, the secondary impact has also been found to negatively affect fuel metering and/or timing, and in the worst case scenario, cause unintended secondary injection during the re-opening bounce of the plunger.

Figure 3:
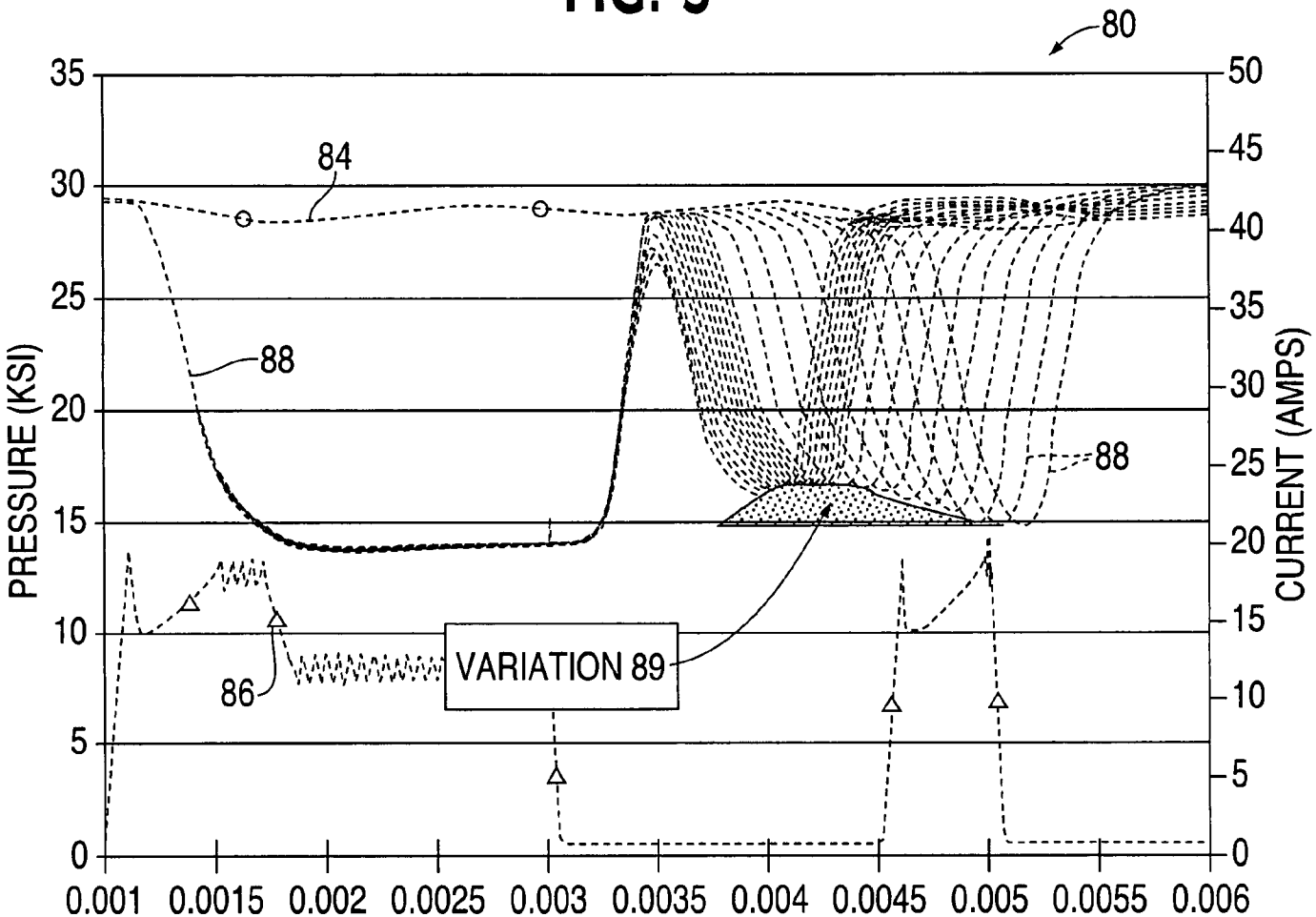
FIG. 3 is a graph showing the variation in armature overtravel in a conventional solenoid actuated flow controller valve.

FIG. 3 shows graph 80 illustrating the variation in armature overtravel in a conventional solenoid actuated flow controller valve having an overtravel feature such as that described in Benson et al. In graph 80, the armature overtravel was derived by measuring the control pressure in the spring chamber which is indicative of the armature overtravel, actual armature overtravel being difficult to measure accurately. Supply pressure is indicated by line 84 (line with circles) in graph 80. A sample current signal that is provided to operate the flow controller valve is shown as line 86 (line with triangles). It should be noted that only one current signal is illustrated in graph 80 for clarity purposes. However, during the experimentation from which the present graph 80 was derived, a plurality of current signals were provided, each current signal corresponding to one of the control pressures indicated by lines 88 which represent armature overtravel during operation of the flow controller valve. The current signal for the first energization event shown in FIG. 3 started at 0.001 seconds and ended at 0.003 seconds for all the test cases shown. The duration of the second energization shown in FIG. 3 as starting at 0.0045 seconds and ending at 0.005 seconds was identical for each case. FIG. 3 shows the effect of varying the starting time of the second energization event. In particular, as can be clearly seen, there is significant variation in the magnitude of the valleys of lines 88 indicating the position of the armature at the peak of armature overtravel. This variation in the valleys of lines 88 is most clearly shown by the variation area 89 which is highlighted. As previously described, such variation in the armature overtravel can cause fueling/timing variation during normal operation and shot-to-shot fueling/timing variation during multi-pulse operation, as well as injector-to-injector fueling/timing variation.

Of course, the above described FIGS. 2 and 3 graphically show performance of the flow controller valve having an overtravel feature during one example operation for illustrative purposes only. As described above relative to FIG. 2, significant secondary impact can occur when the overtraveled armature is returned, the secondary impact potentially resulting in re-opening bounce and corresponding undesirable secondary injection. Moreover, as also described above relative to FIG. 3, the conventional flow controller valves that allow armature overtravel also exhibit significant variation in armature overtravel that can cause fueling/timing variations in many applications.

Figure 4:
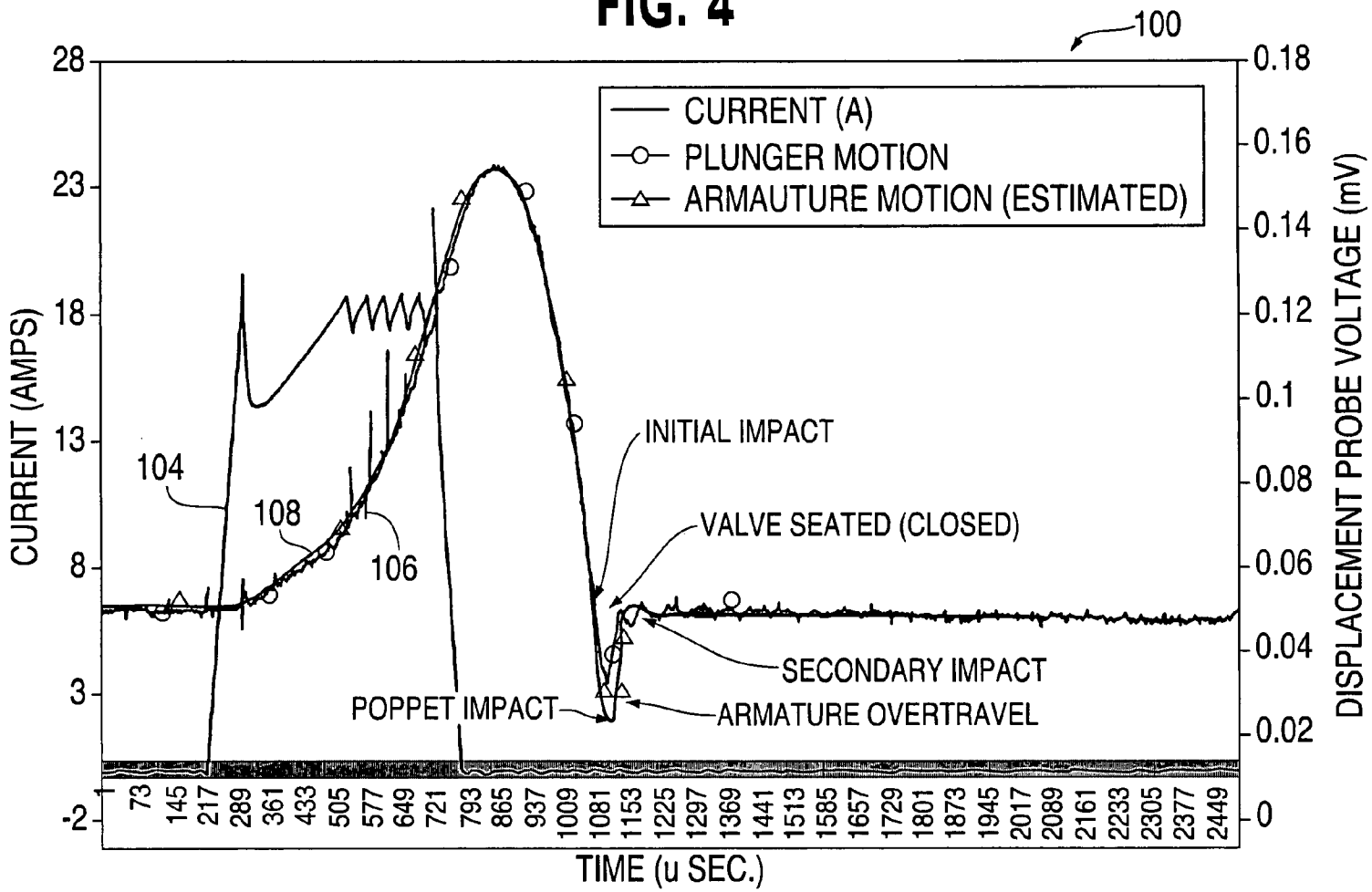
FIG. 4 is a graph showing armature overtravel and reopening bounce caused by the secondary impact of the armature in the solenoid actuated flow controller valve of FIG. 1A.
Figure 5:
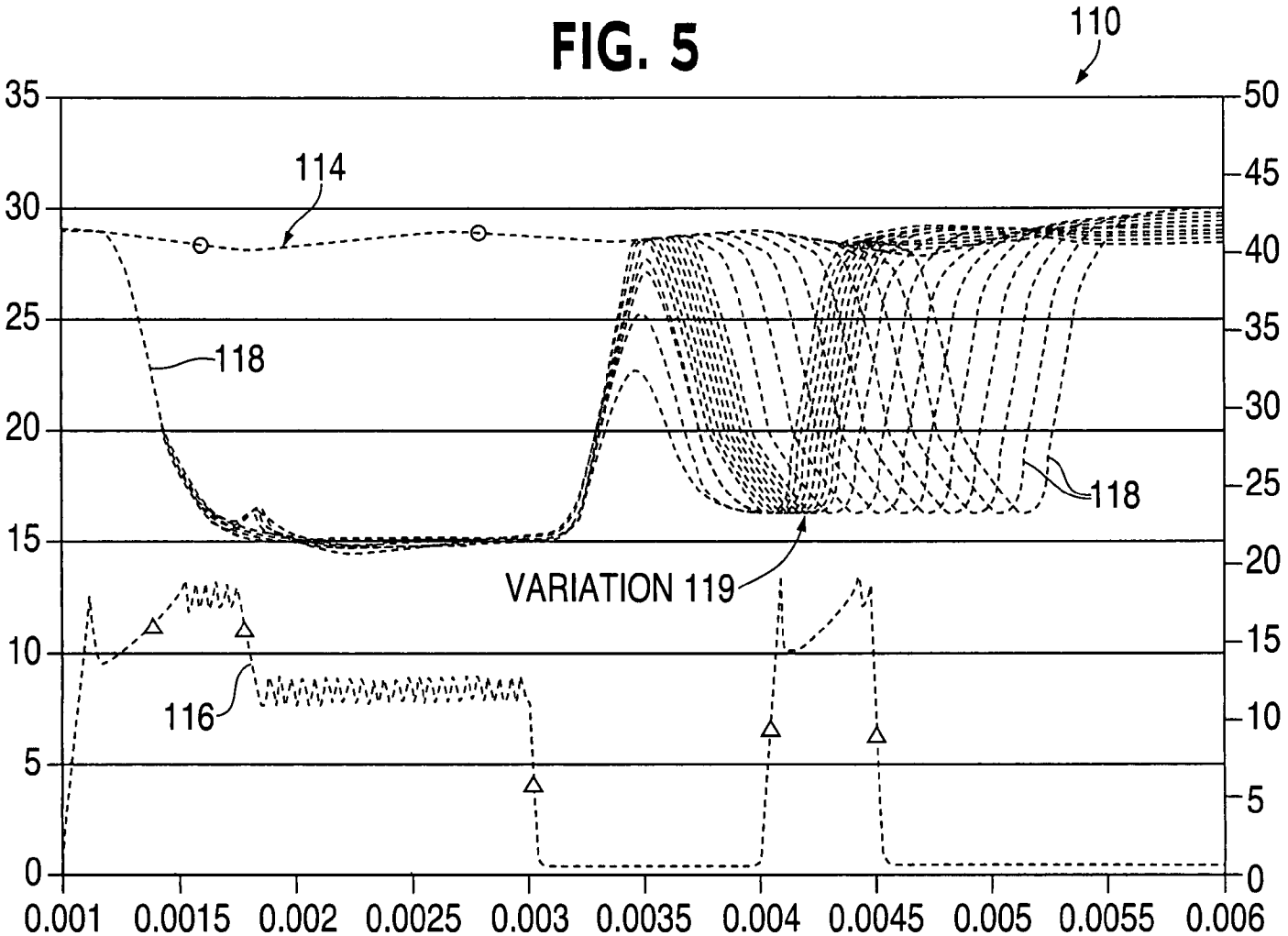
FIG. 5 is a graph showing the variation in armature overtravel in the solenoid actuated flow controller valve of FIG. 1A.

FIGS. 4 and 5 illustrate graphs similar to FIGS. 2 and 3, respectively, that were discussed above for solenoid actuated flow controller valve 10 shown in FIGS. 1A to 1C in which gap G was set at approximately 50 microns. In particular, FIG. 2 shows graph 100 illustrating armature overtravel and re-opening bounce caused by the secondary impact of armature 54 in flow controller valve 10. As shown, line 104 is the current (in amperes) that is provided to flow control valve 10 over time (in microseconds) that operates in the manner described above relative to FIGS. 1A to 1C. Referring to both FIGS. 1C and 4, the provision of the current causes plunger 14 of flow controller valve 10 to move in the manner shown by line 106 (line with circles), the motion of plunger 14 being indicated by the displacement probe voltage. Moreover, armature 54 moves in the manner shown by line 108 (line with triangles) in response to the provided current, the motion of armature 54 again, being estimated.

In the illustrated example, at approximately 1080 microseconds, the initial impact occurs and ball valve 48 impacts valve seat 50 thereby closing flow passage 52. However, as described, armature 54, armature sleeve 56 and retainer 61 continue their displacement, the armature overtravel being shown by the valley of line 108. Armature 54 reaches it's peak armature overtravel at approximately 1120 microseconds and is displaced back so that at approximately 1150 microseconds, armature 54 again engages plunger 14 thereby causing a secondary impact. As can be seen, provision of valve guide 47 and the optimization of the radial area and dimension of gap G ensures minimal secondary impact, thereby providing good control over the armature overtravel and minimizing armature motion caused by the secondary impact.

Thus, the embodiment of the flow controller valve 10 as shown in FIGS. 1A to 1C minimizes re-opening bounce and maintains the load on the valve seat 50 by ball valve 48 thereby allowing maintenance of maximum system operating pressure and sealing margin. Of course, this minimizes the likelihood of fueling/timing being affected, and further reduces the likelihood of unintended secondary injection.

FIG. 5 shows graph 110 illustrating the variation in armature overtravel in solenoid actuated flow controller valve 10 of FIGS. 1A to 1C discussed above. In graph 110, the armature overtravel was again determined by measuring the control pressure in spring chamber 62 which is indicative of the armature overtravel. Supply pressure is indicated by line 114 (line with circles) and a sample current signal that is provided to operate flow controller valve 110 is shown as line 116 (line with triangles). Again, only one current signal is shown for clarity but during the experimentation from which the present graph 110 was derived, a plurality of current signals were provided, each corresponding to one of the control pressure indicated by lines 118 that represent armature overtravel. As can be clearly seen, the valleys of lines 118 indicating the position of the armature at the peak of armature overtravel is substantially constant with minimal variation in area 119.

The performance gain derived from the present invention over conventional flow controller valve with overtravel feature is most clearly seen by comparing the substantially constant overtravel in area 119 as compared to variation area 89 shown in graph 80 of FIG. 3. Consequently, the present invention significantly reduces variation in the armature overtravel thereby reducing the likelihood of fueling/timing variations and undesirable plunger re-openings in various applications.

Figure 6:
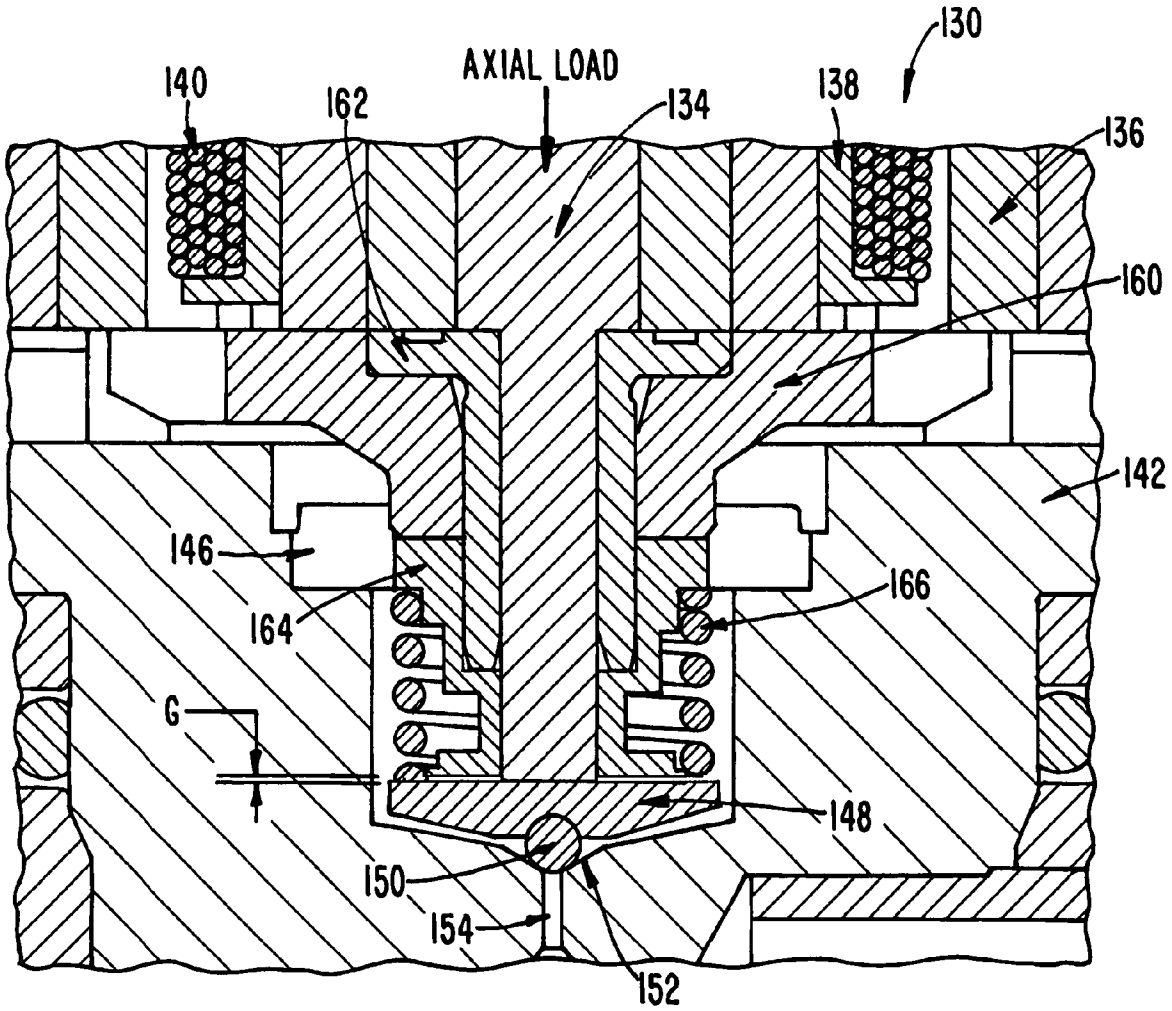
FIG. 6 is a cross sectional view of a solenoid actuated flow controller valve in accordance with another embodiment of the present invention.

FIG. 6 is a cross sectional view of solenoid actuated flow controller valve 130 in accordance with another embodiment of the present invention. Flow controller valve 130 is generally constructed like flow controller valve 10 discussed above relative to FIGS. 1A to 1C and function in a generally similar manner. Thus, many similar components are not shown in the cross sectional view of flow controller valve 130. Flow controller valve 130 includes valve plunger 134 mounted for reciprocal movement, valve actuator assembly 136 for selectively moving valve plunger 134 between retracted and extended positions. Valve actuator assembly 136 includes solenoid assembly 138 including coil 140 operable in the manner previously described. Armature housing 142 includes recess cavity 146, valve plunger 134 extending through recess cavity 146 to abut valve guide 148 that engages ball valve 150. Ball valve 150 seals along valve seat 152 to block flow through fuel passage 154. Solenoid assembly 138 also includes armature 160 mounted on valve plunger 134 via armature sleeve 162 for operating valve plunger 134 between retracted and extended positions. Like the previous embodiment, energization of coil 140 causes armature 160 to move toward solenoid assembly 138 thereby retracting valve plunger 134 to allow ball valve 150 to lift off valve seat 152 into an open position so that fuel can flow through fuel passage 154.

The flow controller valve 130 is provided with an armature overtravel feature in which armature 160, armature sleeve 162, and retainer 164 are movably connected to valve plunger 134 to permit continued movement relative to valve plunger 134 when ball valve 150 is closed via valve guide 148. Specifically, armature sleeve 162 is positioned in an internal bore extending through armature 160 and fixedly attached thereto, armature sleeve 162 moveably receiving valve plunger 134 therethrough. Overtravel biasing spring is disposed around retainer 164 which also engages armature 160 and armature sleeve 162 in the manner shown. The impact on the valve seat 152 is reduced by allowing armature 160, which represents a majority of the moving mass, to separate from valve plunger 134 when plunger 134 is moved to the extended position and ball valve 150 contacts valve seat 152.

In contrast to the flow controller valve 10 described previously relative to FIG. 1C in which overtravel biasing spring 60 is seated against armature housing 24 at one end, flow controller valve 130 in the embodiment of FIG. 6 is configured in an alternative manner. In particular, flow controller valve 130 is configured so that overtravel biasing spring 166 is seated against valve guide 148, and functions to bias armature 160 and armature sleeve 162 into an engaged position against plunger 134 via retainer 164. Thus, the spring force generated by overtravel biasing spring 166 which returns armature 160 to the engaged position in preparation for the next actuation cycle is directed to valve seat 152.

In operation, with actuator assembly 136 de-energized, valve plunger 134 is positioned in the extended position by a bias spring (not shown) so that the ball valve 152 seats against valve seat 152 via valve guide 148. Also, armature 160, armature sleeve 162, and retainer 164 are biased against valve plunger 134 by overtravel biasing spring 166. Armature sleeve 162 and retainer 164 are dimensioned to be separated from the valve guide 148 by gap "G" when the ball valve 152 is in the closed position by the force exerted by overtravel biasing spring 166. When solenoid actuator assembly 136 is activated, armature 160 and valve plunger 134 move upwardly to an open position in which valve guide 148 and ball valve 150 lifts off the valve seat 152 to allow fuel flow.

When actuator assembly 136 is de-energized, armature 160, armature sleeve 162, retainer 164 and valve guide 148 begin to travel as an assembly toward valve seat 152 under the force of the bias spring (not shown) causing the ball valve 150 to become seated on the valve seat 152. When ball valve 150 impacts valve seat 152, valve plunger 134 and valve guide 148 are stopped while an impact force is imparted to valve seat 152. However, armature 160, armature sleeve 162 and retainer 164 are not coupled to plunger 134 and therefore, continue to move downwardly toward valve guide 148.

As these components are decoupled from plunger 134, the fluid pressure in the gap G between armature sleeve 162/retainer 164 and valve guide 148 increases. These components are decelerated and generally stopped by the increasing fluid pressure in the gap G as well as the force exerted by overtravel bias spring 166 which biases retainer 164 in opposite direction of valve seat 152. Of course, depending on the operating conditions, direct contact between the retainer 164 and the valve guide 148 may occur. However, the force generated by the pressurized fluid in gap G in combination with the overtravel bias spring 166 are generally sufficient to stop the motion of armature sleeve 162, retainer 164, and armature 160 thereby resisting contact between these components under normal operating conditions. The dimension and surface area of gap G may be selected to optimize the pressurization of the fluid to thereby control overtravel (in combination with overtravel biasing spring 166) and minimize overtravel variation. Overtravel biasing spring 166 then moves armature sleeve 162, retainer 164, and consequently, armature 160, back into the engaged position against plunger 134.

It should be apparent that in the overtravel mechanism of solenoid actuated flow controller valve 130, overload biasing spring 166 is loaded through valve guide 148. As a result, the overtravel biasing spring 166 acts equally in opposite directions, i.e. in the direction of the valve guide 148 and in the direction of the retainer 164. Thus, any load loss at the interface between ball valve 150/valve seat 152 is the result of any remaining kinetic energy in the overtravel components (i.e. armature 160, armature sleeve 162, and retainer 164) as they are returned to the engaged position and impact against plunger 134. In contrast, when overtravel biasing spring acts against the housing such as that shown in the embodiment of FIGS. 1A to 1C, the load loss at the interface of ball valve/valve seat includes the static load of the overtravel biasing spring, as well as the impact load of the overtravel components. Hence, flow controller valve 130 as shown in the embodiment of FIG. 6 further minimizes the reduction of load on valve seat 50 during the secondary impact so that the sealing margin is not significantly reduced. This allows maximum system operating pressure and reduces the likelihood of re-opening bounce.

Figure 7:
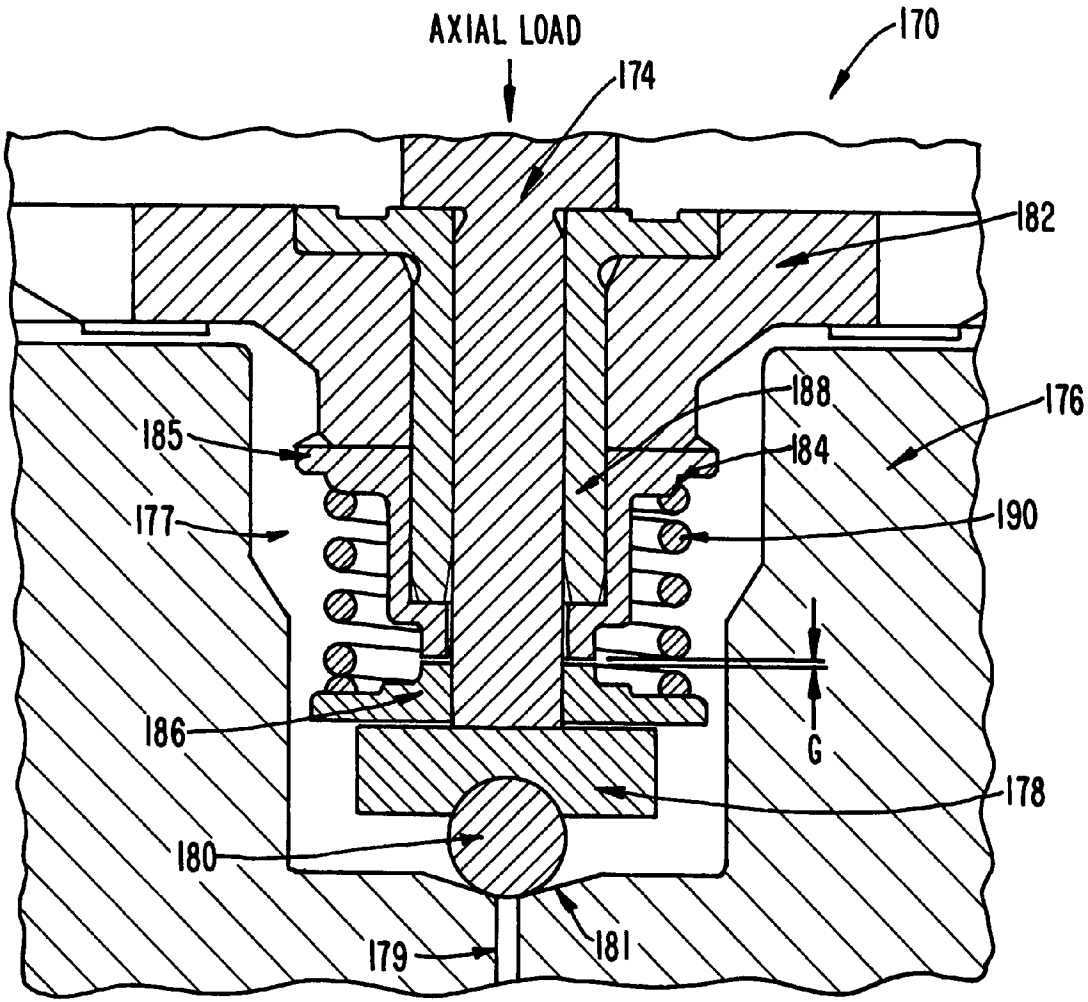
FIG. 7 is a cross sectional view of the solenoid actuated flow controller valve in accordance with still another embodiment of the present invention.

FIG. 7 is a cross sectional view of the solenoid actuated flow controller valve 170 in accordance with still another embodiment of the present invention which is generally constructed like flow controller valve 130 discussed above relative to FIG. 6 and which functions in a similar manner. Thus, many similar components are not shown in the cross sectional view of flow controller valve 170 for clarity purposes.

Flow controller valve 170 includes valve plunger 174 mounted for reciprocal movement between retracted and extended positions. Armature housing 176 includes recess cavity 177, valve plunger 174 extending there through to abut valve guide 178 that engages ball valve 180. Ball valve 180 seals along valve seat 181 formed in armature housing 176 to block flow through fuel passage 179. Armature 182 is mounted on valve plunger 174 via armature sleeve 188 for operating valve plunger 174 between retracted and extended positions. Like the previous embodiment, flow controller valve 170 is provided with an overtravel feature in which armature 170, armature sleeve 188, and retainer 184 are movably connected to valve plunger 174 to permit continued movement of armature 182 and the other components relative to valve plunger 174 when valve plunger 174 closes ball valve 180 against valve seat 181. As a result, the mass of armature 182 is not a contributor to the force applied to valve seat 181 to thereby minimize impact force on ball valve 180 and valve seat 181.

However, in the illustrated embodiment of FIG. 7, retainer 184 is implemented in two pieces, upper piece 185 abutting against armature 182, and lower piece 186 which is separated from the upper piece 185 by gap "G". Lower piece 186 is secured to end of valve plunger 174 as shown so as to maintain their relative positioning with each other. In this regard, lower piece 186 is press fitted to valve plunger 174 in the illustrated embodiment, but may also be secured in any other appropriate manner. In addition, in other implementations, lower piece 186 may be integrally provided at the end of valve plunger 174.

Like the embodiment of FIG. 6, flow controller valve 170 is configured so that the spring force generated by overtravel biasing spring 190 which returns armature 182 to the engaged position is directed to valve seat 178. In this regard, in the present embodiment, overtravel bias spring 190 is seated against lower piece 186 of retainer 184 and acts to bias armature 182 and armature sleeve 188 into the engaged position against plunger 174. As a result, overtravel biasing spring 190 acts equally in opposite directions, and any load loss at ball valve 180/valve seat 181 interface is the result of just the kinetic energy in the overtravel components including armature 182, armature sleeve 188, and upper piece 185 of retainer 184 as they are returned to the engaged position against plunger 174, and not the static loading of overtravel biasing spring 190. Hence, flow controller valve 170 minimizes the reduction of load on valve seat 181 so that the sealing margin is not significantly reduced thereby allowing maximum system operating pressure and reduction in the likelihood of re-opening bounce.

In view of the above, it should be evident to one of ordinary skill in the art that the present invention provides a solenoid actuated flow controller valve having various advantages over flow controller valves of the prior art. In particular, as explained above, the solenoid actuated flow controller valve of the present invention reduces variation in the amount of overtravel to increase accuracy in metering and timing of fuel. Furthermore, as also described above, the flow controller valve of the present invention reduces the secondary impact caused by the returning armature thereby allowing the sealing margin to be maintained so that maximum system operating pressure is not reduced.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. A flow control valve for controlling the flow of fuel in a fuel system, comprising:

a housing including a fuel passage;

a valve device including a valve guide, said valve device movable to close said fuel passage to block fuel flow through said fuel passage, and to open said fuel passage to permit fuel flow through said fuel passage;

a valve plunger engaging said valve device, said valve plunger being adapted to reciprocally move between an extended position in which said valve device is moved to said closed position, and a retracted position in which said valve device is moved to said open position;

an actuator means for reciprocally moving said valve plunger, said actuator means including a solenoid assembly including a coil capable of being energized to move said valve plunger into said retracted position and an armature connected to said valve plunger for movement with said valve plunger toward said extended position;

a retainer that abuts said armature;

an armature overtravel means for permitting continued movement of said armature relative to said valve plunger from an engaged position into a disengaged position when said valve plunger reaches said extended position, said armature overtravel means including an overtravel biasing means for returning said armature from said disengaged position to said engaged position prior to subsequent energization of said coil; and an armature stop means for stopping overtravel of said armature including a fluid film gap, positioned between said retainer and said valve guide, that fluidically resists overtravel movement of said armature.

2. The flow control valve of claim 1, further including a valve seat formed on said housing for sealing engagement by said valve device, said overtravel biasing means being positioned axially between said valve seat and said armature.

3. The flow control valve of claim 2, wherein said overtravel biasing means includes an overtravel biasing spring extending around said valve plunger.

4. The flow control valve of claim 1, further comprising an armature sleeve circumscribing around at least a portion of said valve plunger.

5. The flow control valve of claim 1, wherein said valve device further includes a ball valve.

6. The flow control valve of claim 5, wherein said retainer circumscribes around at least a portion of said valve plunger.

7. The flow control valve of claim 6, wherein one end of said overtravel biasing spring abuts said retainer.

8. The flow control valve of claim 7, wherein another end of said overtravel biasing spring abuts said valve guide of said valve device.

9. The flow control valve of claim 7, wherein said housing includes a recess cavity for receiving said armature, said recess cavity including an inner bottom surface.

10. The flow control valve of claim 9, wherein another end of said overtravel biasing spring abuts said inner bottom surface of said recess cavity.

11. The flow control valve of claim 6, wherein resistance to overtravel movement of said armature is determined at least partially by the dimension of said fluid film gap.

12. The flow control valve of claim 1, further including at least one of a spring disk and a solenoid spacer adapted to control a stroke distance moved by said armature when said solenoid assembly is energized to retract said valve plunger.

13. A flow control valve for controlling the flow of fuel in a fuel system, comprising:

an armature housing including a fuel passage;

a valve device including a ball valve and a valve guide, said valve device being movable to close said fuel passage, and to open said fuel passage;

a valve plunger engaging said valve device, said valve plunger being adapted to reciprocally move between an extended position, and to a retracted position;

a solenoid assembly actuable to move said valve plunger into said retracted position, said solenoid assembly including an armature connected to said valve plunger for movement with said valve plunger toward said extended position, said armature further being adapted to disengage from said valve plunger and to overtravel relative to said valve plunger;

a retainer that circumscribes around at least a portion of said valve plunger and abuts said armature;

an overtravel biasing spring extending around said valve plunger and being adapted to return said armature from said disengaged position to said engaged position; and a fluid film gap positioned between said retainer and said valve guide that fluidically resists overtravel movement of said armature.

14. The flow control valve of claim 13, wherein said housing includes a recess cavity with an inner bottom surface, ends of said overtravel biasing spring abutting said inner bottom surface and said retainer to exert a return force on said armature, said fluid film gap being positioned between said retainer and said valve guide.

15. The flow control valve of claim 13, wherein ends of said overtravel biasing spring abut said retainer and said valve guide to exert a return force on said armature, said fluid film gap being positioned between said retainer and said valve guide.

* * * * *